US009149400B2

(12) United States Patent
Serhan

(10) Patent No.: US 9,149,400 B2
(45) Date of Patent: Oct. 6, 2015

(54) ADJUSTABLE MATTRESS AND ADJUSTABLE BED SYSTEM INCORPORATING THE SAME

(71) Applicant: Drive Medical Design & Mfg., Port Washington, NY (US)

(72) Inventor: Michael Serhan, Acadia, CA (US)

(73) Assignee: Drive Medical Design & Mfg., Port Washington, NY (US)

( * ) Notice: Subject to any disclaimer, the term of this patent is extended or adjusted under 35 U.S.C. 154(b) by 0 days.

(21) Appl. No.: 13/804,418

(22) Filed: Mar. 14, 2013

(65) Prior Publication Data

US 2014/0259415 A1 Sep. 18, 2014

(51) Int. Cl.

| | |
|---|---|
| ***A61G 7/002*** | (2006.01) |
| ***A61G 7/015*** | (2006.01) |
| ***A47C 27/05*** | (2006.01) |
| ***A47C 27/14*** | (2006.01) |
| *A61G 13/12* | (2006.01) |

(52) U.S. Cl.

CPC ..... *A61G 7/002* (2013.01); *A47C 27/05* (2013.01); *A47C 27/142* (2013.01); *A61G 7/015* (2013.01); *A47C 27/053* (2013.01); *A47C 27/056* (2013.01); *A61G 13/128* (2013.01)

(58) Field of Classification Search

CPC ..... A47C 27/05–27/06; A47C 27/14–27/15; A61G 7/02–7/015; A61G 7/128

USPC ..... 5/613, 722, 600, 690

See application file for complete search history.

(56) References Cited

U.S. PATENT DOCUMENTS

| | | | | |
|---|---|---|---|---|
| 5,520,438 | A * | 5/1996 | Stulik | 297/284.11 |
| 8,800,978 | B2 * | 8/2014 | Tarazona De La Asuncion | 267/142 |

* cited by examiner

*Primary Examiner* — Peter M Cuomo
*Assistant Examiner* — Brittany Wilson
(74) *Attorney, Agent, or Firm* — Carter DeLuca Farrell & Schmidt, LLP

(57) ABSTRACT

An adjustable mattress includes a body portion and an extension portion. The body portion includes a first plurality of spaced-apart fingers extending outwardly from at least one edge thereof. The extension portion includes a second plurality of spaced-apart fingers extending outwardly therefrom. The first plurality of fingers are configured for inter-fit engagement with the second plurality of fingers. The extension portion is movable relative to the body portion to vary a degree of inter-fit engagement of the fingers between a first position, wherein the adjustable mattress defines a first dimension, and a second position, wherein the adjustable mattress defines a second dimension.

16 Claims, 7 Drawing Sheets

ADJUSTABLE MATTRESS AND ADJUSTABLE BED SYSTEM INCORPORATING THE SAME

BACKGROUND

1. Technical Field

The present disclosure relates to mattresses and, more particularly, to adjustable mattresses and adjustable bed systems for use therewith.

2. Background of Related Art

Medical beds are used in both home care and in more formalized medical settings, e.g., hospital rooms. A typical medical bed generally includes a bed frame supporting a mattress thereon, and a base assembly or leg assemblies supporting the bed frame. Some medical beds incorporate mechanisms for adjusting the height of the bed frame relative to the floor, e.g., to raise and lower the patient, and/or for articulating the bed frame, e.g., to position the patient in a lying position, a sitting position, etc. In addition, some medical beds provide for adjustment of the bed frame in the length and/or width dimensions. Such medical beds are capable of accommodating taller and/or larger patients. However, a need still exits for providing an adjustable mattress for use independently of or in conjunction with an adjustable medical bed to better accommodate taller and/or lager patients.

SUMMARY

In accordance with the present disclosure, an adjustable mattress is provided. The adjustable mattress includes a body portion and an extension portion. The body portion includes a first plurality of spaced-apart fingers extending outwardly from at least one edge portion thereof. The extension portion includes a second plurality of spaced-apart fingers extending outwardly therefrom. The first plurality of fingers are configured for inter-fit engagement with the second plurality of fingers. The extension portion is movable relative to the body portion to vary a degree of inter-fit engagement of the fingers between a first position, wherein the adjustable mattress defines a first dimension, and a second position, wherein the adjustable mattress defines a second dimension.

In embodiments, the first and second pluralities of fingers are inter-fittingly engaged with one another via resilient compression.

In embodiments, the first and second pluralities of fingers define complementary configurations to facilitate the inter-fit engagement therebetween. More specifically, in embodiments, one of the first and second pluralities of fingers define concavely scalloped configurations while the other of the first and second pluralities of fingers define convexly scalloped configurations.

In embodiments, one of the at least one edge portions is a side edge portion. In such embodiments, the extension portion is movable relative to the body portion to vary a width dimension of the adjustable mattress. Additionally or alternatively, one of the at least one edge portions may be an end edge portion. In such embodiments, the extension portion is movable relative to the body portion to vary a length dimension of the adjustable mattress.

In embodiments, the first and second pluralities of fingers are movable between a plurality of incremental inter-fit engagement positions to define a plurality of incremental dimensions of the adjustable mattress.

In embodiments, the adjustable mattress further includes an outer cover configured to enclose the body portion and extension portion. The outer cover may be configured to be expandable between at least two sizes for accommodating different dimensions of the adjustable mattress.

In embodiments, the body portion and/or the extension portion are formed from a resiliently compressible material or resiliently compressible materials.

Also provided in accordance with the present disclosure is an adjustable mattress including an inner member and an outer cover. The inner member includes a body portion and an extension portion, which may be configured similarly to any of the embodiments described above. The outer cover is configured to enclose the inner member and is expandable between a first size and a second size to accommodate the first and second dimensions, respectively, of the inner member.

In embodiments, the outer cover includes a main body portion and an auxiliary portion. The auxiliary portion is movable from a contracted configuration to an extended configuration to expand the outer cover from the first size to the second size.

An adjustable bed system provided in accordance with the present disclosure includes an expandable bed frame, and an adjustable mattress. The expandable bed frame is expandable between a first dimension and a second dimension. The adjustable mattress is configured to sit atop the expandable bed frame and may be configured similar to any of the embodiments described above. The adjustable mattress is adjustable between a third dimension corresponding to the first dimension of the expandable bed frame, and a fourth dimension corresponding to the second dimension of the expandable bed frame.

In embodiments, the expandable bed frame includes a plurality of sections pivotably coupled to one another to permit articulation of the expandable bed frame.

In embodiments, at least one of the plurality of sections of the expandable bed frame is telescopically expandable to vary a dimension of the expandable bed frame.

In embodiments, the expandable bed frame and the adjustable mattress are expandable in at least one of a width dimension and a length dimension.

BRIEF DESCRIPTION OF THE DRAWINGS

Various embodiments of the presently disclosure are described with reference to the accompanying drawing figures, wherein.

DETAILED DESCRIPTION

Various exemplary embodiments of the present disclosure are described in detail with reference to the drawings, wherein like references characters identify similar or identical elements.

Figure 3A:
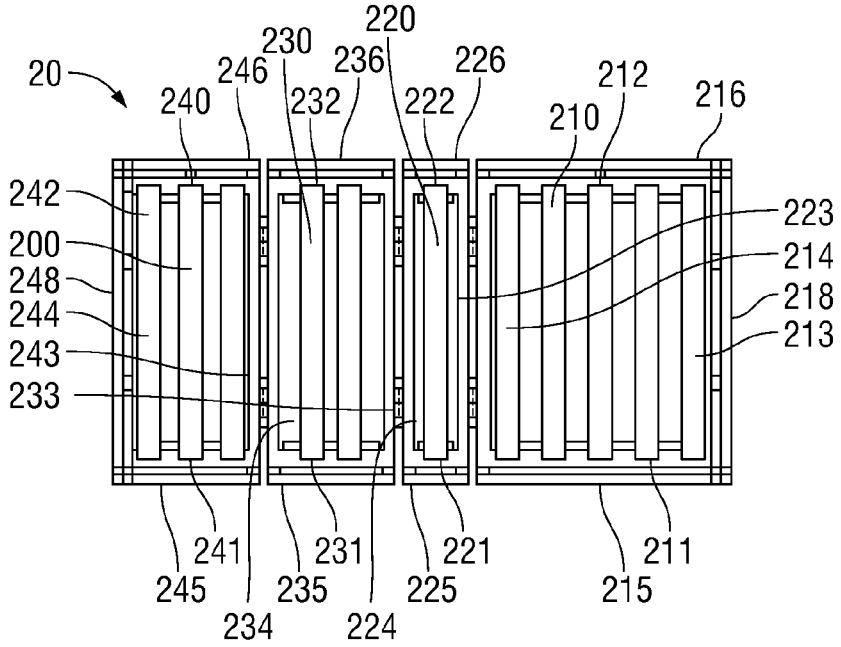
FIG. 3A is a top view of the adjustable bed of FIG. 1, wherein the bed frame is disposed in a retracted position.
Figure 3B:
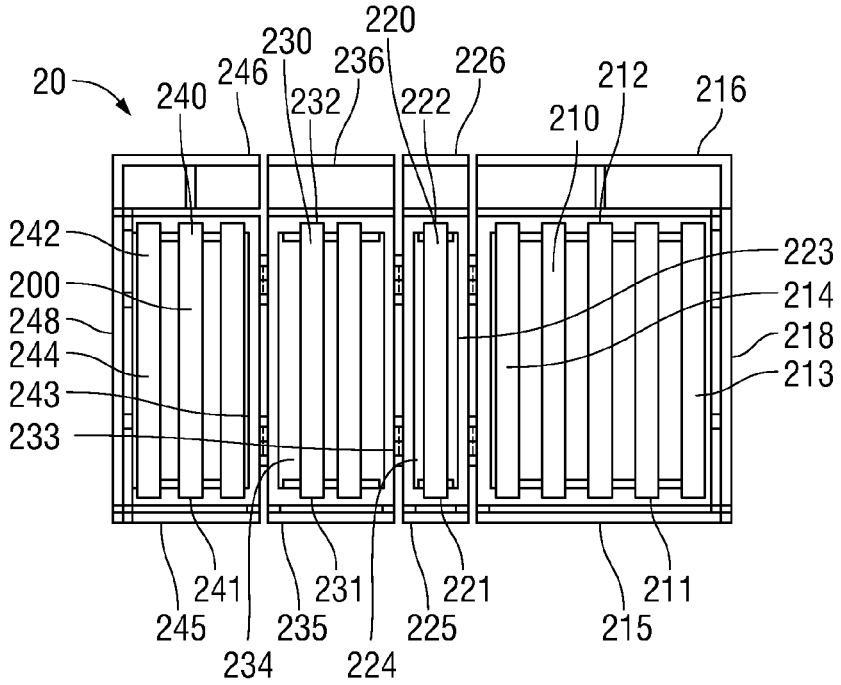
FIG. 3B is a top view of the adjustable bed of FIG. 1, wherein the bed frame is disposed in a width-extended position.
Figure 3C:
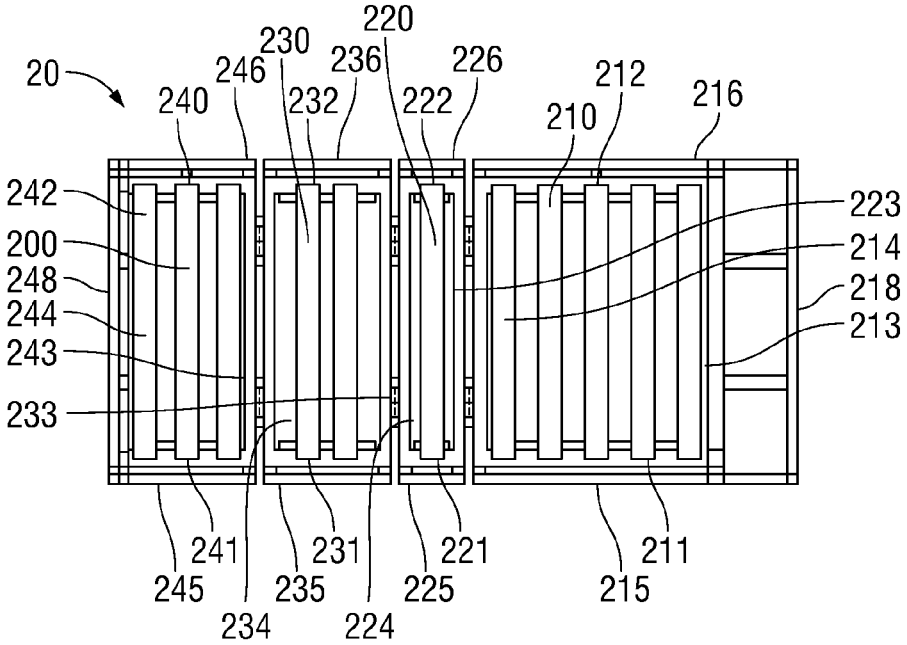
FIG. 3C is a top view of the adjustable bed of FIG. 1, wherein the bed frame is disposed in a length-extended position.
Figure 3D:
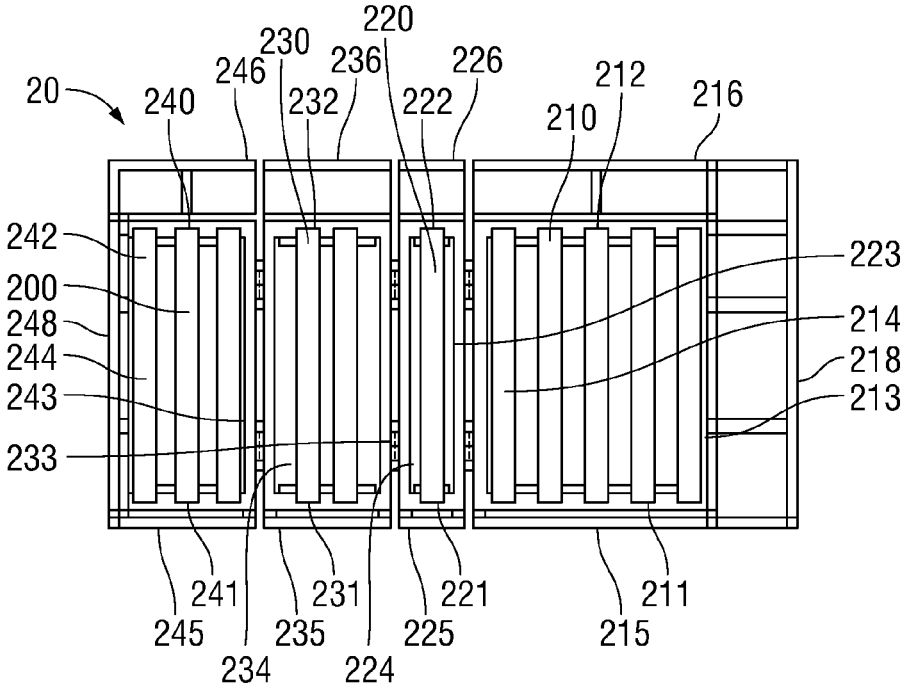
FIG. 3D is a top view of the adjustable bed of FIG. 1, wherein the bed frame is disposed in both the width and length-extended positions.
Figure 4:
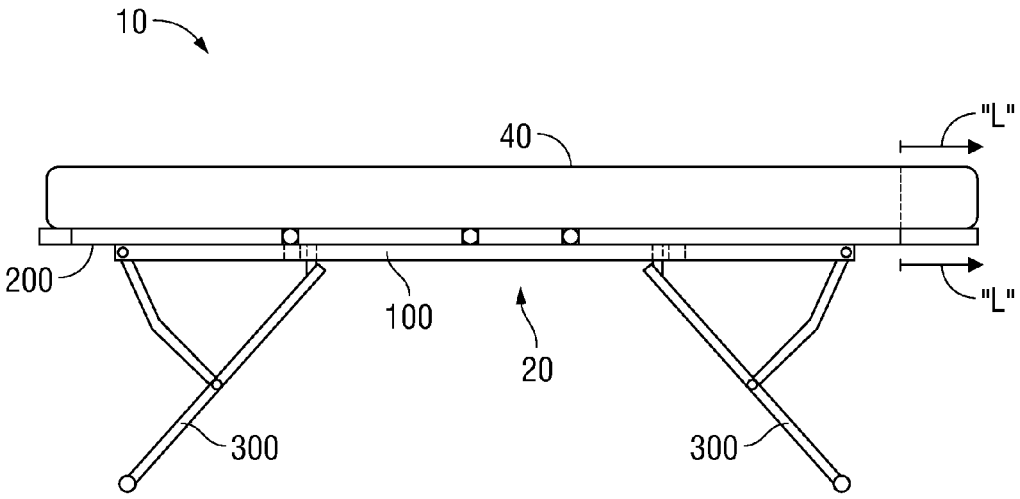
FIG. 4 is a side view of one embodiment of an adjustable bed system provided in accordance with the present disclosure, wherein the adjustable bed system includes an adjustable mattress disposed on the adjustable bed of FIG. 1 and wherein the bed and mattress are disposed in length-extended positions.
Figure 5:
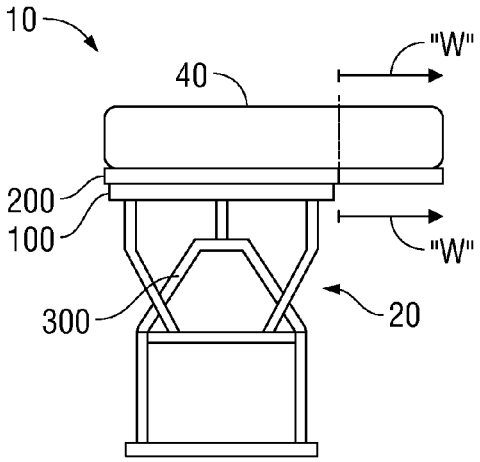
FIG. 5 is a front view of the adjustable bed system of FIG. 4, wherein the bed and mattress are disposed in width-extended positions.

Turning now to FIGS. 1-5, an adjustable bed system provided in accordance with the present disclosure is shown generally identified by reference numeral 10 (FIGS. 4-5). Bed system 10 (FIGS. 4-5) is configured for long term care, although bed system 10 (FIGS. 4-5) may also find application in short term care, and/or may be used in both hospital settings as well as in private home care settings. Bed system 10 generally includes an adjustable bed 20 and an adjustable mattress 40 (see FIGS. 4-5). Adjustable bed 20 includes a first, fixed frame 100, a second, articulatable frame 200, and a pair of leg assemblies 300. Adjustable mattress 40, which will be described in greater detail below, is configured to sit atop second frame 200 (see FIGS. 4-5).

Figure 1:
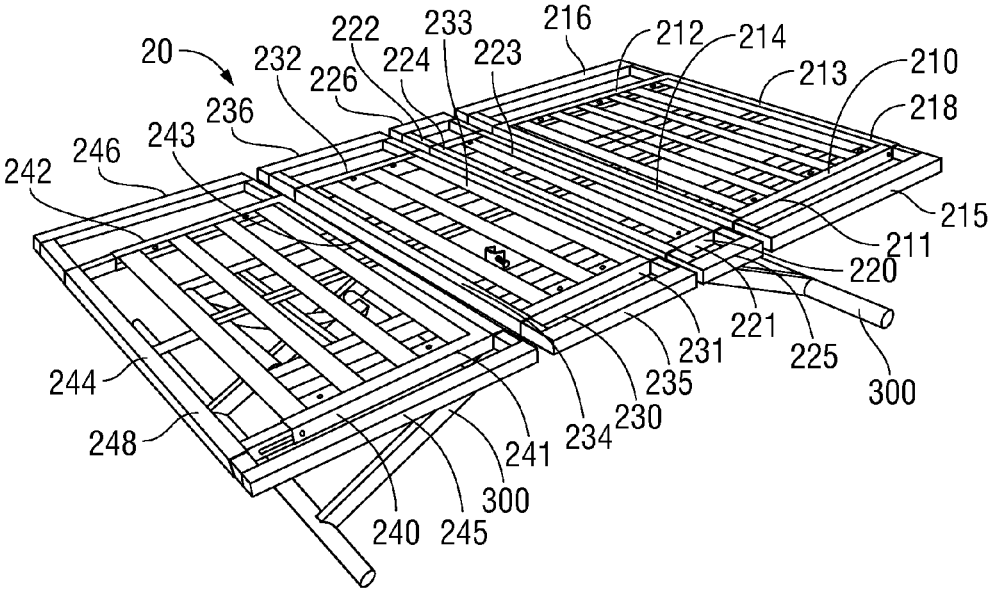
FIG. 1 is a side, perspective view of one embodiment of an adjustable bed provided in accordance with the present disclosure.
Figure 2A:
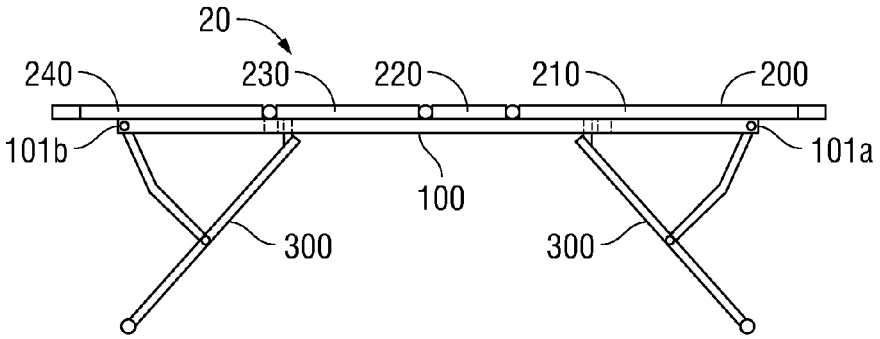
FIG. 2A is a side view of the adjustable bed of FIG. 1, wherein the bed frame is disposed in a non-articulated condition.
Figure 2B:
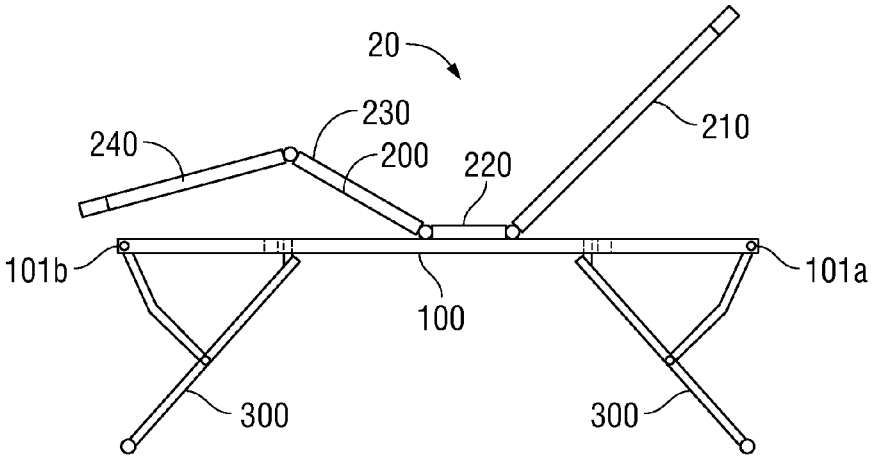
FIG. 2B is a side view of the adjustable bed of FIG. 1, wherein the bed frame is disposed in an articulated condition.

With reference to FIGS. 1-2B, first frame 100 of articulatable bed 20 defines a generally rectangular-shaped configuration and includes a head end 101*a* and a foot end 101*b*. Leg assemblies 300 are operably coupled to first frame 100 and extend downwardly therefrom for supporting and permitting height-adjustment of first frame 100. First frame 100 may further be configured to support head and foot boards (not shown) at the head and foot ends 101*a*, 101*b*, respectively, thereof. Second frame 200 includes a plurality of sections 210, 220, 230, 240 pivotably coupled to one another and movable relative to one another and first frame 100 at least between a lying position (FIG. 2A), a seated position, a legs-raised position, and a seated and legs raised position (FIG. 2B). A plurality of actuators (not shown) are provided for articulating second frame 200 through its plurality of articulated positions and/or for manipulating leg assemblies 300 to raise and lower the height of first frame 100 relative to the floor.

With reference to FIGS. 3A-3D, in conjunction with FIGS. 1-2B, second frame 200 of adjustable bed includes a back section 210, a hip section 220, a thigh section 230, and a lower leg section 240, although greater or fewer than four (4) sections and/or different configurations of sections 210-240 are also contemplated. Hip section 220 of second frame 200 is fixedly secured to first frame 100 and defines a generally rectangular configuration having first and second sides 221, 222, respectively, and first and second ends 223, 224, respectively. Each of the first and second sides 221, 222 of hip section 220 includes a respective lateral extension portion 225, 226 that is telescopically coupled thereto. Lateral extension portions 225, 226 are selectively extendable relative to hip section 220 to vary the width dimension of hip section 220 (see FIGS. 3A and 3B). Any suitable releasable securement mechanism (not shown) may be provided for locking lateral extension portions 225, 226 in position relative to hip section 220 and, thus, to fix the width dimension of hip section 220 at discrete locking positions between a fully retracted position (FIGS. 1-3A) and a fully extended position (FIGS. 3B and 3D), or for selectively fixing the width dimension of hip section 220 at any position between the fully retracted and fully extended positions. Alternatively, hip section 220 may be maintained in position via friction fitting of the telescoping lateral extension portions 225, 226 relative to second frame 200. It is envisioned that the width dimension of hip section 220 (as well as the other sections 210, 230, 240 of second frame 200) be extendable from about 36 inches to about 42 inches to accommodate patients of varying sizes, although other ranges are also contemplated.

Back section 210 of second frame 200 is pivotably coupled to hip section 220 at second end 214 of back section 210 and is positioned adjacent to hip section 220 towards head end 101*a* of first frame 100. Accordingly, back section 210 can be pivoted relative to hip section 220 and first frame 100 between the lying position and the seated position. Back section 210 defines a generally rectangular configuration that is dimensioned to support the upper body of a patient and is configured to be both length and width adjustable. More specifically, back section 210 includes first and second sides 211, 212, first and second ends 213, 214, a pair of lateral extension portions 215, 216, and an end extension portion 218. Lateral extension portions 215, 216 are telescopically engaged to first and second sides 211, 212, respectively, of back section 210 and are selectively extendable relative thereto to vary the width dimension of back section 210. Lateral extension portions 215, 216 may otherwise be similar to and/or may include any of the features of lateral extension portions 225, 226 of hip section 220, as described above. End extension portion 218 is telescopically engaged to end 213 of back section 210 and is selectively extendable relative thereto to vary the length of back section 210. Similar to lateral extension portions 225, 226 of hip portion 220, end extension portion 218 of back section 210 may include any suitable releasable securement mechanism (not shown) for locking end extension portion 218 in position relative to back section 210 and, thus, for fixing the length of back section 210.

Thigh section 230 of second frame 200 is pivotably coupled to hip section 220 at first end 233 of thigh section 230 and is positioned adjacent to hip section 220 towards foot end 101*b* of first frame 100 to allow pivoting of thigh section 230 relative to hip section 220 and first frame 100 between a substantially straight position and a raised position. Thigh section 230 defines a generally rectangular configuration that is dimensioned to support the thighs and upper legs of a patient. More specifically, thigh section 230 includes first and second sides 231, 232, first and second ends 233, 234, and a pair of lateral extension portions 235, 236. Lateral extension portions 235, 236 are telescopically engaged to sides 231, 232 of thigh section 230 for selectively adjusting the width dimension of thigh section 230. Lateral extension portions 235, 236 may otherwise be similar to and/or may include any of the features of lateral extension portions 225, 226 of hip section 220, as described above.

Foot section 240 of frame 200 is pivotably coupled to thigh section 230 at first end 243 of foot section 240 and towards foot end 101*b* of first frame 100. Foot section 240 defines a generally rectangular configuration that is dimensioned to support the lower legs and feet of a patient. Foot section 240 is not directly coupled to first frame 100, but, rather, is both pivotably and movably coupled to first frame 100 via thigh section 230. Foot section 240 is pivotable relative to thigh section 230 between a substantially straight position and a downwardly-angled position. Foot section 240 includes first and second sides 241, 242, first and second ends 243, 244, a pair of lateral extension portions 245, 246, and an end extension portion 248. Lateral extension portions 245, 246 are telescopically engaged to first and second sides 241, 242, respectively, of foot section 240 and are selectively extendable relative thereto to vary the width dimension of foot section 240. Lateral extension portions 245, 246 may otherwise be similar to and/or may include any of the features of lateral extension portions 225, 226 of hip section 220, as described above. End extension portion 248 is telescopically engaged to end 214 of foot section 240 and is selectively extendable relative thereto to vary the length of foot section 240. End extension portion 248 may otherwise be similar to and/or may include any of the features of end extension portion 218 of back section 210, as described above. End extension portion 248 of foot section 240, in conjunction with or independently of end extension portion 218 of back section 210, may be adjusted along the length thereof to adjust the overall length of second frame 200 between about 76 inches and about 86 inches, although other ranges are also contemplated.

Turning now to FIGS. 3A-3D, the various sections 210, 220, 230, 240 of second frame 200 may be extended and/or retracted to achieve a desired length and/or width dimension of second frame 200. For example, as shown in FIG. 3A, when lateral extension portions 215, 225, 235, 245, 216, 226, 236, 246 are disposed in their respective fully retracted positions and when end extension portions 218, 248 are disposed in their respective fully retracted positions, second frame 200 defines minimum width and length dimensions.

As shown in FIG. 3B, the width dimension of second frame 200 is extended by extending lateral extension portions 216, 226, 236, 246, although width adjustment may additionally or alternatively be effected by extending lateral extension portions 215, 225, 235, 245. In the configuration of FIG. 3B, the length of second frame 200 remains at a minimum dimension.

FIG. 3C shows a configuration wherein the width dimension of second frame 200 defines a minimum, e.g., wherein lateral extension portions 215, 225, 235, 245, 216, 226, 236, 246 are disposed in their respective fully retracted positions, while end extension portion 218 has been extended to extend the length dimension of second frame 200. Length adjustment may additionally or alternatively be effected by extending end extension portion 248.

FIG. 3D shows a configuration wherein both the width and length of second frame 200 has been extended by extending lateral extension portions 216, 226, 236, 246 and end extension portion 218, respectively. Other configurations achievable through the extension and/or retraction of any or all of the extension portions of second frame 200 are also contemplated.

Turning now to FIGS. 4-5, as mentioned above, adjustable mattress 40 is configured to sit atop second frame 200 of bed assembly 20 to provide a more comfortable support surface for bed system 10, while bed assembly 20 provides the necessary structural rigidity to bed system 10. Adjustable mattress 40 defines minimum width and length dimensions that approximate the width and length dimensions of second frame 200 when second frame 200 is disposed in the fully retracted position (see FIG. 3A). As can be appreciated, extension of second frame 200 in the width direction "W" (see FIG. 5) and/or length direction "L" (see FIG. 4), as described above, necessitates a corresponding extension of adjustable mattress 40 in the width direction "W" and/or length direction "L" to provide full coverage of adjustable mattress 40 atop second frame 200. In particular, adjustable mattress 40 may be extended between about 76 inches and about 86 inches in the length direction "L" and/or between about 36 inches and about 42 inches in the width direction "W." Although adjustable mattress 40 is only described below with respect to adjustment in the width direction "W" for purposes of brevity, it is envisioned that adjustable mattress 40 be additionally or alternatively configured for adjustment in the length direction "L" (at either or both ends thereof) in a similar fashion. Further, although only one side of adjustable mattress 40 is described below as being width adjustable for purposes of brevity, it is envisioned that either or both sides of adjustable mattress 40 be configured for adjustment in the width "W" direction.

Figure 6:
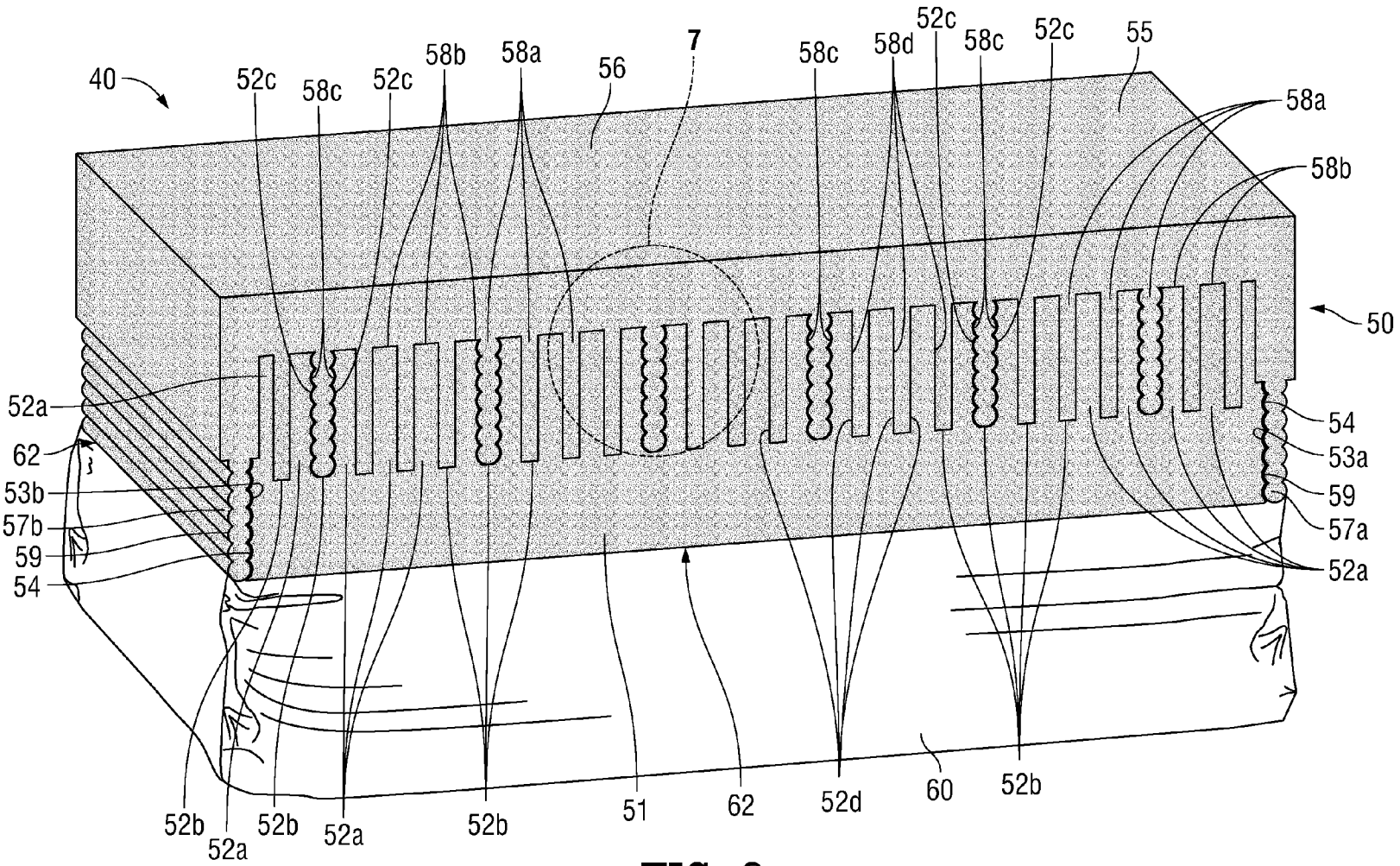
FIG. 6 is a perspective view of the adjustable mattress of the adjustable bed system of FIG. 4, wherein a portion of the outer cover has been removed to show the internal configuration of the mattress.
Figure 7:
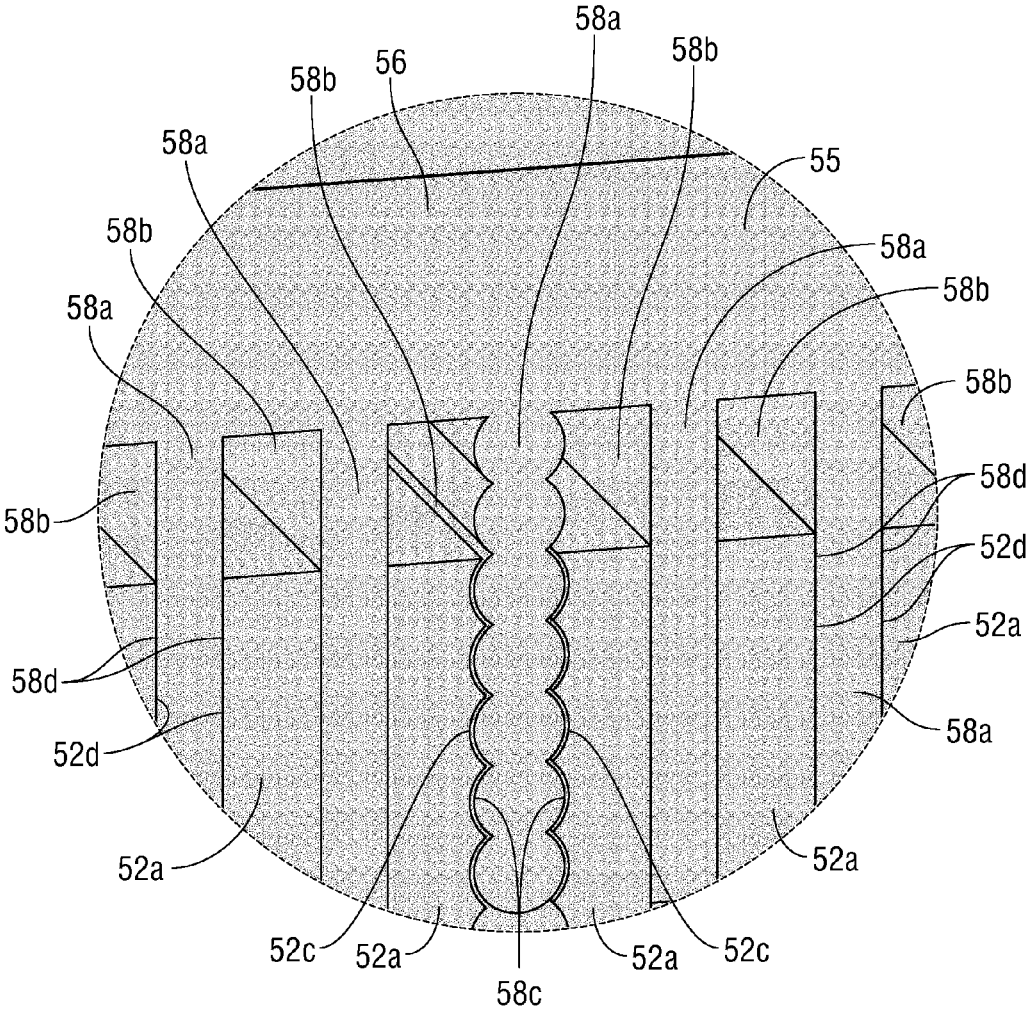
FIG. 7 is an enlarged, perspective view of the area of detail indicated as "7" in FIG. 6, wherein a width dimension of adjustable mattress has been expanded.

With reference to FIGS. 6-7, adjustable mattress 40 generally includes an inner assembly 50 and an outer cover 60. Although partially removed in FIG. 6 to show inner assembly 50, outer cover 60 is configured to fully surround and enclose inner assembly 50. Outer cover 60 will be described in greater detail below. Inner assembly 50 of adjustable mattress 40 is formed from a resiliently compressible material, e.g., polyurethane foam (although other materials are also contemplated), and includes a body portion 51 and an extension portion 55. In embodiments where inner assembly 50 is width adjustable on both sides thereof, an extension portion 55 is provided on each side of inner assembly 50. Similarly, in embodiments where inner assembly 50 is length adjustable, an extension portion 55 is additionally or alternatively provided on either or both ends of inner assembly 50.

Body portion 51 of inner assembly 50 of adjustable mattress 40 includes a plurality of spaced-apart fingers 52*a* extending outwardly from a side thereof. Fingers 52*a* define a plurality of slots 52*b* therebetween. End walls 53*a*, 53*b* of body portion 51 define concavely scalloped surfaces 54, although other configurations, e.g., square-wave, saw-toothed, diamond-shaped, etc., are also contemplated. Likewise, opposing surfaces 52*c* of at least some pairs of adjacent fingers 52*a* define concavely scalloped configurations (although other configurations, such as those mentioned above, are also contemplated). Thus, with at least some pairs of adjacent fingers 52*a* defining opposed concavely scalloped surfaces 52*c*, at least some of slots 52*b* are defined by concavely scalloped surfaces 52*c* on either side thereof. The remainder of fingers 52*a* and slots 52*b* define linear surfaces 52*d*. In the embodiment shown in FIG. 6, every fourth slot 52*b* is defined by concavely scalloped surfaces 52*c* (with the remainder defining linear surfaces 52*d*), although it is envisioned that greater or fewer slots 52*b* define this concavely scalloped configuration, or that any other configuration of fingers 52*a* and slots 52*b* may be provided.

Continuing with reference to FIGS. 6-7, extension portion 55 of inner assembly 50 of adjustable mattress 40 includes a side portion 56, a pair of end walls 57*a*, 57*b*, and a plurality of spaced-apart fingers 58*a* extending inwardly from side portion 56 in a similar direction as end walls 57*a*, 57*b*. End walls 57*a*, 57*b* define convexly scalloped surfaces 59 that are shaped complementary to surfaces 54 of end walls 53*a*, 53*b* of body portion 51 so as to inter-fittingly engage therewith. Fingers 58*a*, similar to fingers 52*a* of body portion 51, define a plurality of slots 58*b* therebetween and are complementary-shaped relative to fingers 52*a* and slots 52*b* of body portion 51 so as to permit inter-fit engagement of fingers 52*a*, 58*a* and slots 52*b*, 58*b*, respectively, with one another. Further, surfaces 58*c* of at least some of fingers 58*a* define convexly scalloped configurations (although other configurations, such as those mentioned above, are also contemplated), while the remainder of fingers 58*a* and slots 58*b* define linear surfaces 58*d*. Although every fourth finger 58*a* is defined by convexly scalloped surfaces 58*c* (with the remainder defining linear surfaces 52*d*), as shown in FIG. 6, it is envisioned that any suitable configuration of fingers 58*a* and slots 58*b* of extension portion 55 may be used, provided fingers 58*a* and slots 58*b* of extension portion 55 are complementary to the configuration of fingers 52*a* and slots 52*b* of body portion 51.

As best shown in FIG. 7, slots 52*b*, 58*b* of body portion 51 and extension portion 55, respectively, are dimensioned similar to or slightly smaller than the dimensions of fingers 52*a*, 58*a* of body portion 51 and extension portion 55, respectively, to facilitate resiliently compressive inter-fit engagement therebetween. This inter-fit engagement between fingers and slots 52*a*, 52*b* and 58*a*, 58*b* of body portion 51 and extension portion 55, respectively, is facilitated by the complementary mating of the concavely scalloped surfaces 52*c* of body portion 51 with the convexly scalloped surfaces 58*c* of extension portion 55. Likewise, the concavely scalloped surfaces 54 of end walls 53*a*, 53*b* of body portion 51 and convexly scalloped surfaces 59 of end walls 57*a*, 57*b* of extension portion 55 are configured for similar complementary mating engagement with one another. As a result of the above-described inter-fit engagement between body portion 51 and extension portion 55, body portion 51 and extension portion 55 are maintained in substantially fixed position relative to one another, thus maintaining a desired width dimension of adjustable mattress 40.

Referring again to FIGS. 6-7, in order to adjust the width dimension of adjustable mattress 40, extension portion 55 is urged apart from body portion 51 with sufficient force so as to overcome the inter-fit engagement between fingers and slots 52*a*, 52*b* and 58*a*, 58*b* of body portion 51 and extension portion 55, respectively, and between end walls 53*a*, 53*b* of body portion 51 and end walls 57*a*, 57*b* of extension portion 55, respectively, such that extension portion 55 may be incrementally repositioned relative to body portion 51. That is, the plurality of scallops defining surfaces 52*c* and 58*c* provide for a plurality of incremental engagement positions of body portion 51 and extension portion 55 that corresponding to incremental width adjustments of adjustable mattress 40. For example, as shown in FIG. 6, fingers and slots 52*a*, 52*b* and 58*a* 58*b* of body portion 51 and extension portion 55, respectively, may be fully inter-fit with one another to define the minimum width dimension of adjustable mattress 40. Alternatively, fingers and slots 52*a*, 52*b* and 58*a* 58*b* of body portion 51 and extension portion 55, respectively, may be minimally inter-fit with one another to define a maximum width dimension of adjustable mattress 40, or, as shown in FIG. 7, may be inter-fit at an incremental position therebetween to achieve a desired width dimension of adjustable mattress 40. As can be appreciated, once the desired width dimension of adjustable mattress 40 has been achieved, body portion 51 and extension portion 55 may be released, allowing the inter-fit engagement therebetween to maintain body portion 51 and extension portion 55 in substantially fixed position relative to one another, thus maintaining the desired width dimension of adjustable mattress 40.

Figure 8A:
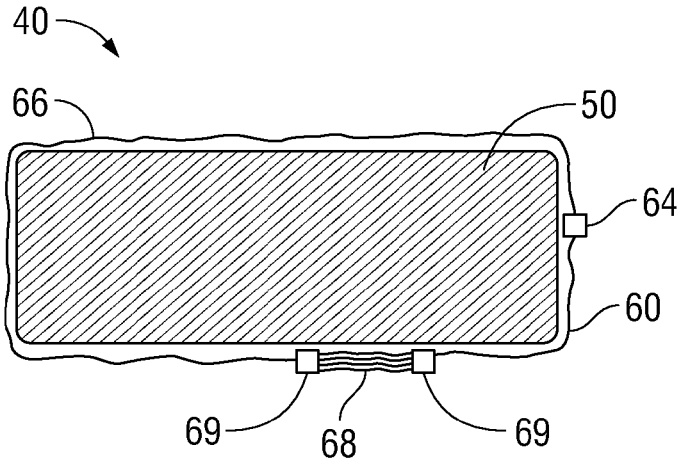
FIG. 8A is a cross-sectional view of the adjustable mattress of FIG. 6, wherein the mattress is disposed in a retracted position.
Figure 8B:
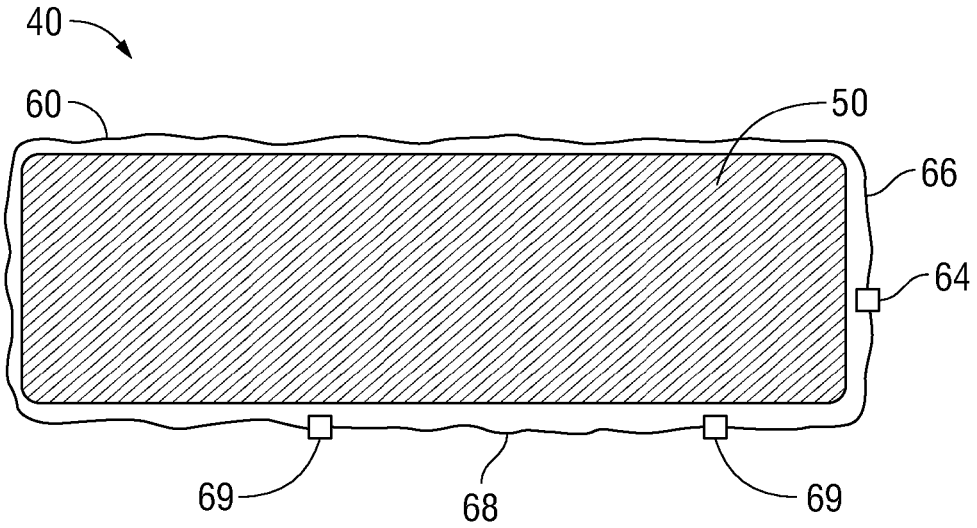
FIG. 8B is a cross-sectional view of the adjustable mattress of FIG. 6, wherein the mattress is disposed in an extended position.

Turning now to FIGS. 8A-8B, in conjunction with FIG. 6, as mentioned above, adjustable mattress 40 includes an outer cover 60 configured to fully surround and enclose inner assembly 50 to protect inner assembly 50 from fluids, debris, other contamination, damage, wear, etc. Outer cover 60 may be formed from any suitable material, monolithically or otherwise. Outer cover 60 includes at least one mouth 62 (FIG. 6) configured to permit passage of inner assembly 50 therethrough to position outer cover 60 about inner assembly 50. Mouth 62 (FIG. 6) of outer cover may be releasably closable via one or more releasable securement mechanisms 64, e.g., zippers, snaps, ties, Velcro™, etc. Outer cover 60 further includes a main body portion 66 and an expandable auxiliary portion 68. Main body portion 66 and expandable auxiliary portion 68, in its retracted state, are dimensioned to cover inner assembly 50 when inner assembly 50 defines smaller dimensions. In order to accommodate larger, expanded configurations of inner assembly 50, however, auxiliary portion 68 is expandable to an expanded state, wherein outer cover 60 is capable of fully surrounding and enclosing the expanded inner assembly 50. More specifically, the material forming auxiliary portion 68 may be bunched, or folded and secured in the retracted state via one or more releasable securement mechanisms 69, e.g., zippers, snaps, ties, Velcro™, etc. so as to cover the retracted inner assembly 50 without a substantial excess of "loose" material. In order to expand auxiliary portion 68 and, thus, outer cover 60, auxiliary portion 68 is released, un-bunched or un-folded, and then re-secured via securement mechanisms 69 in the expanded state, thus providing sufficient material to allow outer cover 60 to fully surround and enclose the expanded inner assembly 50

The above description, disclosure, and figures should not be construed as limiting, but merely as exemplary of particular embodiments. It is to be understood, therefore, that the disclosure is not limited to the precise embodiments described, and that various other changes and modifications may be effected by one skilled in the art without departing from the scope or spirit of the present disclosure. Additionally, persons skilled in the art will appreciate that the features illustrated or described in connection with one embodiment may be combined with those of another, and that such modifications and variations are also intended to be included within the scope of the present disclosure. Therefore, the above description should not be construed as limiting, but merely as exemplifications of particular embodiments.

What is claimed is:

1. An adjustable mattress expandable in at least one dimension, the adjustable mattress comprising:

a body portion including a first plurality of spaced-apart fingers extending outwardly from at least one edge portion thereof; and an extension portion including a second plurality of spaced-apart fingers extending outwardly therefrom, the first plurality of fingers configured for inter-fit engagement with the second plurality of fingers via resilient compression, the first and second pluralities of fingers defining complementary configurations to facilitate the inter-fit engagement therebetween, wherein one of the first and second pluralities of fingers define concavely scalloped configurations and wherein the other of the first and second pluralities of fingers define convexly scalloped configurations, the body portion and the extension portion cooperating to define a patient-supporting surface, the extension portion movable relative to the body portion to vary a degree of inter-fit engagement of the fingers between a first position, wherein the patient-supporting surface defines a first dimension, and a second position, wherein the patient-supporting surface defines a second dimension.

2. The adjustable mattress according to claim 1, wherein the at least one edge portion is a side edge portion and wherein the extension portion is movable relative to the body portion to vary a width dimension of the patient-supporting surface.

3. The adjustable mattress according to claim 1, wherein the at least one edge portion is an end edge portion and wherein the extension portion is movable relative to the body portion to vary a length dimension of the patient-supporting surface.

4. The adjustable mattress according to claim 1, wherein the first and second pluralities of fingers are movable between a plurality of incremental inter-fit engagement positions to define a plurality of incremental dimensions of the patient-supporting surface.

5. The adjustable mattress according to claim 1, further comprising an outer cover configured to enclose the body portion and extension portion.

6. The adjustable mattress according to claim 5, wherein the outer cover is expandable between at least two sizes for accommodating different dimensions of the patient-supporting surface.

7. The adjustable mattress according to claim 1, wherein at least one of the body portion and the extension portion is formed from a resiliently compressible material or resiliently compressible materials.

8. An adjustable mattress expandable in at least one dimension, the adjustable mattress comprising:

an inner member, including:

a body portion including a first plurality of spaced-apart fingers extending therefrom; and an extension portion including a second plurality of spaced-apart fingers extending therefrom, the first and second pluralities of fingers defining complementary configurations configured for inter-fit engagement with one another wherein one of the first and second pluralities of fingers define concavely scalloped configurations and wherein the other of the first and second pluralities of fingers define convexly scalloped configurations, the body portion and the extension portion cooperating to define a patient-supporting surface, the extension portion movable relative to the body portion to vary a degree of inter-fit engagement of the fingers between a first position, wherein the patient-supporting surface defines a first dimension, and a second position, wherein the patient-supporting surface defines a second dimension; and an outer cover configured to enclose the inner member, the outer cover expandable between a first size and a second size to accommodate the first and second dimensions, respectively, of the patient-supporting surface.

9. The adjustable mattress according to claim 8, wherein the inner member is expandable in at least one of a width dimension and a length dimension of the patient-supporting surface.

10. The adjustable mattress according to claim 8, wherein the first and second pluralities of fingers are movable between a plurality of incremental inter-fit engagement positions to define a plurality of incremental dimensions of the patient-supporting surface.

11. The adjustable mattress according to claim 8, wherein the outer cover includes a main body portion and an auxiliary portion, the auxiliary portion movable from a contracted configuration to an extended configuration to expand the outer cover from the first size to the second size.

12. An adjustable mattress expandable in at least one dimension, the adjustable mattress comprising:

a body portion including a first plurality of spaced-apart fingers extending outwardly from at least one edge portion thereof; and an extension portion including a second plurality of spaced-apart fingers extending outwardly therefrom, the first and second pluralities of fingers defining complementary configurations and configured for inter-fit engagement with one another, wherein one of the first and second pluralities of fingers define concavely scalloped configurations and wherein the other of the first and second pluralities of fingers define convexly scalloped configurations, the body portion and the extension portion cooperating to define a patient-supporting surface, the extension portion movable relative to the body portion to vary a degree of inter-fit engagement of the fingers between a first position, wherein the patient-supporting surface defines a first dimension, and a second position, wherein the patient-supporting surface defines a second dimension.

13. The adjustable mattress according to claim 12, wherein the extension portion is movable relative to the body portion to vary a width dimension of the patient-supporting surface.

14. The adjustable mattress according to claim 12, wherein the extension portion is movable relative to the body portion to vary a length dimension of the patient-supporting surface.

15. The adjustable mattress according to claim 12, wherein the first and second pluralities of fingers are movable between a plurality of incremental inter-fit engagement positions to define a plurality of incremental dimensions of the patient-supporting surface.

16. The adjustable mattress according to claim 12, wherein at least one of the body portion and the extension portion is formed from a resiliently compressible material or resiliently compressible materials.

* * * * *